United States Patent [19]

Manning

[11] 4,117,806

[45] Oct. 3, 1978

[54] CONVECTION BAFFLES

[75] Inventor: William P. Manning, Tulsa, Okla.

[73] Assignee: Combustion Engineering, Inc., Windsor, Conn.

[21] Appl. No.: 699,778

[22] Filed: Jun. 25, 1976

[51] Int. Cl.[2] ..... F22B 1/02; F22D 7/00

[52] U.S. Cl. ..... 122/33; 122/409; 62/52

[58] Field of Search ..... 122/33, 136, 406, 409, 122/410, 34; 62/52; 165/106

[56] References Cited

U.S. PATENT DOCUMENTS

| | | | |
|---|---|---|---|
| 739,774 | 9/1903 | Auldjo | 122/410 |
| 3,603,101 | 9/1971 | Sullivan | 122/33 X |

FOREIGN PATENT DOCUMENTS

| | | | |
|---|---|---|---|
| 1,211,076 | 10/1959 | France | 165/106 |

*Primary Examiner*—Kenneth W. Sprague
*Attorney, Agent, or Firm*—Arthur L. Wade

[57] ABSTRACT

A heat source and an element to be heated are immersed in a common liquid heat exchange medium. Baffles are arranged to guide the heated portion of the liquid upward and toward the heated element and guide the cooled portion of the liquid downward and toward the heat source in such a manner as to avoid conflict between the two flows to maximize the heat exchange between the source and element.

4 Claims, 4 Drawing Figures

CONVECTION BAFFLES

BACKGROUND OF THE INVENTION

1. Field of the Invention

The present invention relates to the indirect heating of an element by a heat source using a circulated heat exchange medium guided to avoid stagnation of flow in the body of the medium. More specifically, this invention relates to arranging the heat source, the element to be heated, and baffles to avoid conflict between the rising streams of the heated portions of the medium and the sinking streams of the cooled portions of the medium as the medium circulates between the heat source and the element and to thereby maximize the circulation and consequently the heat transfer between the heat source and element.

2. Description of the Prior Art

Convective heat transfer is a standard design consideration in equipment in which heat is transmitted by a fluid medium from a heat source to a structure to be heated. In broad principle there is no present mystery in the transmission of heat by exposing as much surface area as feasible at both the heating of the medium by the source and the heating of the structure by the medium. Next, it is accepted that uniform distribution of the medium over the heat exchange surfaces is a key to the effectiveness and efficiency of this heat exchange. Also, it is recognized that the medium must be moved dynamically over both heat exchange surfaces to militate against stagnation.

The prior art is replete with examples of how these basic factors are given weight in the design of heating units. To pick an example, the disclosure of U.S. Pat. No. THURLEY 2,993,479 issued July 25, 1961, shows the discharge of products of combustion from a primary furnace and these products being guided over heated tubes. The products of combustion became the fluid medium which is directed by means of baffles into uniform, dynamic contact with the tubes to be heated.

The U.S. Pat. No. WALKER et al 2,354,932 issued Aug. 1, 1944, disclosed a liquid heat transfer medium for conveying heat from a heat-supplying element to a heat-absorbing element, both of which are submerged in the medium. A tank 1 is divided by a horizontal partitioning member 8 which separated the tank into upper and lower compartments 9 and 10. Firetube 19 is in the lower compartment 10. Coil 28 is in the upper compartment 9. Liquid heat transfer medium 40 fills the remainder of the tank.

The heat liquid beneath partition 8 rises and is guided by a baffle up one end of partition 8. The elevated heated liquid then flows over coil 28 which extracts heat from the medium. The cooled liquid then sinks and is guided by a baffle down the second end of partition 8 to complete the thermo-syphonic cycle. It was expected that this flow would have a pattern that dynamically eliminates stagnation and maximizes heat exchange.

However, it is apparent that the medium flows parallel the lengths of both the firetube 19 and coil 28. It is fundamental that the rate of heat exchange is less in this parallel flow arrangement than in transverse flow. In addition, the necessary support and/or spacing structure for the tubes inherently impedes the flow of the medium over the tube surfaces. As the thermal driving force on the liquid medium is upward, the partition 8 over most of its length directs the flow of the medium perpendicular to this driving force. The hope for more efficient operation due to the disclosed arrangements gradually faded.

It was years before the limitations in the theories of the WALKER et al U.S. Pat. No. 3,354, 932 were completely evaluated. All the literature of the Assignor, National Tank Company, featured the disclosure up into the 1960's. The partition 8 was finally eliminated from the literature and fabricated units. Today, the coil to be heated is simply mounted above the firetube. But this arrangement does not solve the problem.

The present arrangement of coil above firetube is more easily analyzed. And problems are evident. The thermal flow force on the medium by the firetube is upward. The thermal flow force on the medium by the coil is downward. Obviously, these flow patterns are in opposition and with no means of controlling or separating the flow patterns there is stagnation. A new form of baffle is required to resolve this conflict of flows.

More specifically, the upward flow path for the heated liquid must be preserved and the downward flow path for the cooled liquid must be provided, and baffles are needed to guide these liquid flows into separate channels or patterns. The thermal flow patterns or forces must not directly conflict or the resulting opposition and stagnation will prevent maximum heat exchange.

SUMMARY OF THE INVENTION

It is an object of the invention to circulate a liquid heat exchange medium between a source of heat and a higher element to be heated without conflict between the rising stream of the heated portion of the medium and the descending stream of the cooled portion of the medium.

It is another object of the invention to provide a baffle system which will separate the up and down flow paths from each other in a thermosyphon cycle between the heat source and the element to be heated.

Another object is to promote and control the circulation of the medium as it rises from the heat source so the heated medium will completely encompass the element to be heated.

Another object is to maximize the circulation of the medium between the heat source and the element to be heated and to increase heat transfer between these structures.

The present invention contemplates an elongated heat source extended horizontally in the lower volume of a shell. An elongated conduit, or tube bundle, in which the fluid is to be heated extends horizontally in the upper volume of the shell. The heat source and tube bundle are generally parallel to each other, with the bundle above the source. Baffles extend along substantially the entire length of, and above, the heat source with a transverse shape to guide the upward flow of liquid after the liquid has picked up heat from the source. The flow is directed to the reaches of the tubes of the bundle so that the heated medium can penetrate and contact all of the tubes. The liquid is cooled by the bundle and sinks toward the heat source. A path is provided for this cooled liquid and it is distinct from the heated liquid rising from the source. When the cooled liquid is reheated the cycle repeats. The circulation continues for as long as heat is generated by the source and absorbed by the element to be heated. The flows of the liquid heat exchange medium are directed transverse to the elongated, horizontal, heat source, and coil bundle and in no way oppose each other. The combination of flow of the liquid medium transverse to the horizontal, elongated heat source and horizontal, elongated tube bundle and non-conflicting paths for the heated portion of the medium and cooling portion of the medium completely encompasses the bundle with the medium and maximizes heat transfer.

Other objects, advantages, and features of the invention will become apparent to one skilled in the art upon consideration of the written specifications, appended claims, and attached drawings.

DRAWING DESCRIPTION

DESCRIPTION OF THE PREFERRED EMBODIMENT

Figure 1:
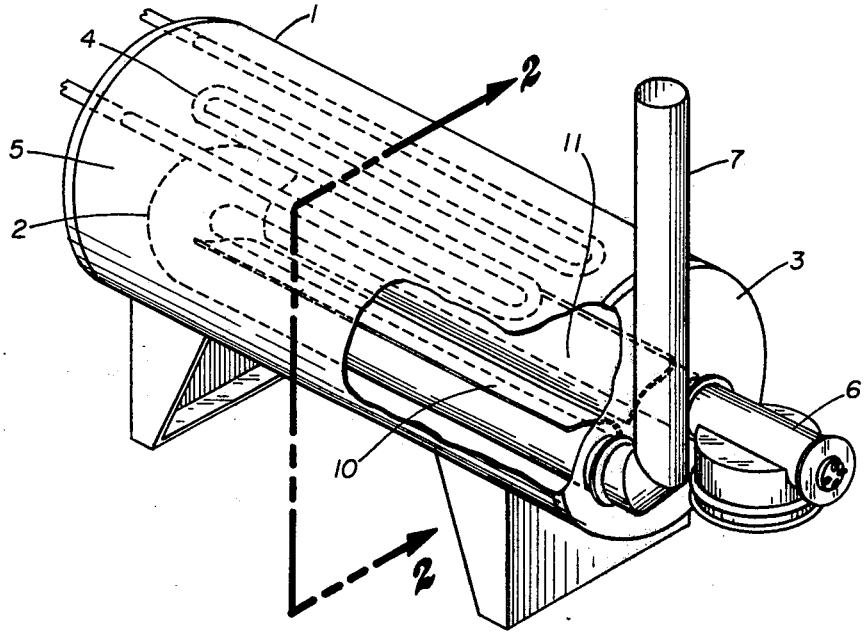
FIG. 1 is a partially sectioned perspective view of a heating unit embodying the invention.

FIG. 1 discloses the essential elements of an industrial, indirect heater in which the invention is embodied. This unit burns gaseous and/or liquid fuels to heat the liquid bath directly and the process stream indirectly.

Shell 1 is in the form of a cylinder, closed at each end. Firetube 2 is mounted through head which closes one end of the cylinder. This tube extends its middle section horizontally along a major portion of the lower volume of the shell 1.

Above firetube 2 is mounted the reaches of a bundle 4 of tubes. Through these tubes of bundle 4 is passed the fluid process stream requiring heat from the firetube 2.

The remaining volume of shell 1 is filled with a liquid heat exchange medium 5. This medium 5 is the transfer agent linking the firetube 2 and tube bundle 4. Heated by tube 2, medium 5 flows in streams up to tube bundle 4. Cooled by tube bundle 4, medium 5 sinks in streams down to firetube 2. The cycle repeats, and the medium continually transfers heat from the firetube to the tube bundle for as long as heat is generated in the firetube.

Firetube 2 has an entrance to which a burner at 6 is connected. This burner discharges gaseous products of combustion into the firetube, and the gases travel the entire length for eventual discharge up stack 7. The overall process is a relatively simple one and this much of it is readily understood from the FIG. 1 disclosure.

Figure 2:
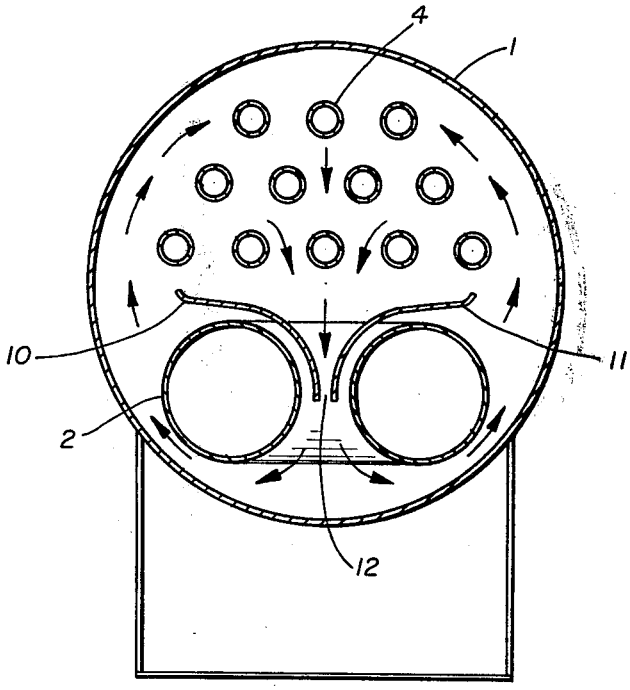
FIG. 2 is a section taken along lines 2—2 in FIG. 1.

The problem is that simply placing tube bundle 4 above firetube 2 results in inefficient transfer of heat with the medium cycling between them. FIG. 2 shows the tube bundle 4 clearly above the firetube 2. Without the invention embodied in the baffles it is evident that the streams of ascending medium run head on into the descending streams of medium.

This conflict of medium streams will result in considerable stagnation of the flows. The result is inevitably an inefficient transfer of heat. The rising hot streams of medium 5 may never reach the uppermost tubes of bundle 4. What is needed is a guidance system for the two flows which will obviate interference between them. FIG. 1 discloses baffles 10 and 11 in position between firetube 2 and bundle 4 to carry out this purpose. FIG. 2 discloses the baffle shape in more detail and indicates the pattern of medium flows which is the result of the baffles in place.

Baffles 10 and 11 are each relatively long plates which are extended horizontally above, and substantially the length of, the legs of firetube 2. The transverse dimensions, or width, of each baffle 10 and baffle 11 are formed to guide the streams of heated medium toward the outside wall of shell 1 and around and up the side of bundle 4. The heated streams then flow in toward bundle 4, penetrating the reaches of the tubes which make up the bundle. Heat transfer readily takes place and the streams of medium are cooled.

As the medium cools, it sinks toward the bottom of shell 1. Baffles 10, 11 now function to guide and converge the sinking streams as they travel to the bottom of shell 1 where they are again heated by firetube 2. The cycle repeats. The baffles function as a static guide to keep the heated and cooled portions of the medium separate and circulating thermosyphonically.

Note that the flow of the medium within this system is transverse to the firetube and the tubes of the bundle 4. It is an accepted fact of engineering that this transverse flow over the member to be heated or cooled is more efficient than longitudinal flow. Therefore, the baffles not only prevent conflict between flows but provides transverse flow relative to both firetube 2 and bundle 4.

The foregoing system is perhaps best understood from the disclosures of FIG. 2. Arrows indicate the pattern of the medium flow. The two legs of the single firetube are mounted to extend equal distances above the bottom of shell 1. The baffles 10, 11 are, in cross-section, gracefully swept into roughly an S shape to guide the heated medium from around the firetube to the wall of the shell 1. The inside edges of the baffles are spaced from each other at 12 to form a path for the cooled and sinking medium.

Figure 3:
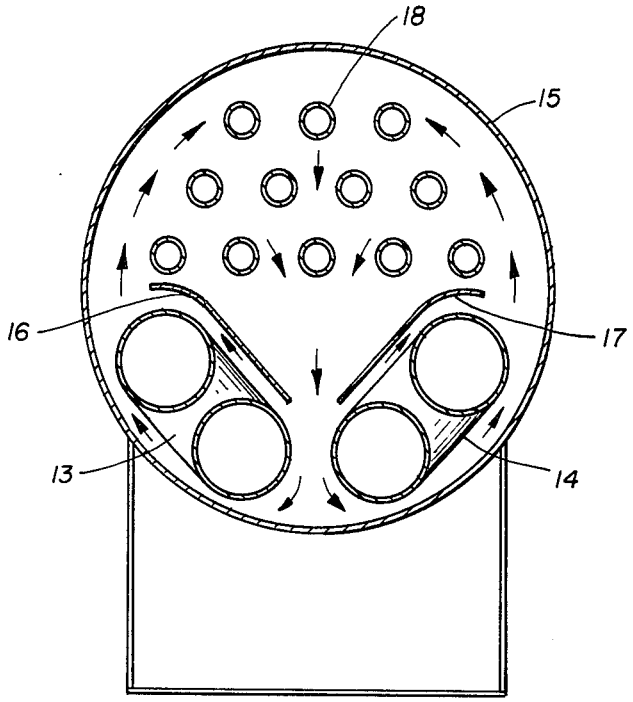
FIG. 3 is similar to FIG. 2 and shows an alternative form of baffle for a plurality of firetubes.

The amount of heating required may demand two firetubes. FIG. 3 discloses the presently conventional arrangement of the two firetubes 13 and 14 above the bottom of a heater shell 15.

In FIG. 3 baffles 16 and 17 are mounted above their respective firetubes. As do baffles 10 and 11, baffles 15 and 16 guide the heated medium from the firetube to the side of shell 15 and up and around the side of coil bundle 18. The similarity to the structure of FIG. 2 is apparent from inspection.

More specifically, FIG. 3 discloses a cross-section of horizontally extended shell 15. The heat source is in the form of the pair of return-bend firetubes 13 and 14, the legs of each tube arranged in a plane inclined at an acute angle to the vertical from the lower volume of the shell. As in FIG. 1, both of these firetubes extend their lengths horizontally through a substantial length of the lower volume of the shell. Coil bundle 18 is adequately described extended horizontally through a substantial length of the upper volume of shell 15.

Baffle plates 16 and 17 are more specifically defined as extended parallel to and above and substantially the length of the legs of each return-bend firetube 13 and 14. As the legs of the firetube are in a plane inclined at an acute angle to the vertical, the baffles 16 and 17, as plates, are inclined at the same angle. So positioned, the plates 16 and 17 form a guide for the streams of heated liquid rising from the legs of the firetubes. The plates guide the streams outward, toward the walls of shell 15. The liquid continues to rise, flowing into the direct contact with coil bundle 18. The bundle 18 absorbs heat from the streams. The cooled liquid sinks at the center of the bundle and drops between the lower edges of plates 16 and 17 to flow over the firetubes to be reheated and recycled.

Figure 4:
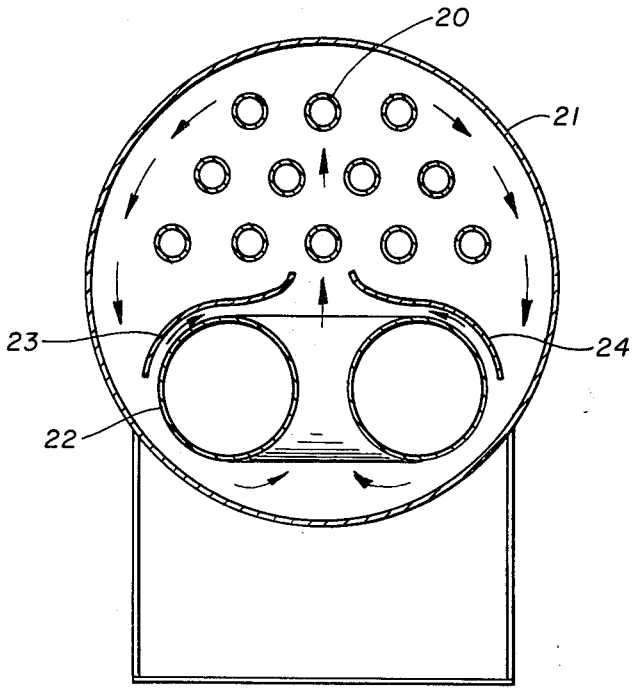
FIG. 4 is similar to FIG. 2 and shows an alternative form of baffle for a single firetube.

FIG. 4 is established to disclose an alternative arrangement of baffles for a single firetube similar to that of FIG. 2 and also embodies the invention. FIG. 2 discloses the baffles 10 and 11 formed to guide the streams of heated medium toward the outside wall of shell 1 while the medium cooled by the bundle 4 sinks directly downward to the heat source 10.

FIG. 4 discloses how baffles can be placed and shaped to guide and direct the streams of heated medium directly up toward the center of tube bundle 20. The cooled and sinking medium from tube bundle 20 is then displaced by the continually rising heated medium towards the sides of shell 21 from where the medium is guided into contact with firetube 22 for repeat of the cycle.

A somewhat more specific description of the structure of FIG. 4 is that shell 21 is disclosed in cross-section. The shell 21 is actually horizontally extended as is shell 1 of FIGS. 1 and 2. The heat source is firetube 22, arranged as is firetube 2 of FIGS. 1 and 2. Coil bundle 20 is mounted within the shell 1 to extend horizontally through a substantial length of the upper volume of the shell 21.

Baffle plates 23 and 24 are each extended parallel to and above and substantially the length of each leg of firetube 22. A substantial portion of the transverse dimensions of each plate 23 and 24 is inclined to guide the rising streams of heated liquid toward the center of the shell and upward into the center of coil bundle 20. With this specific arrangement, the streams of heated liquid guided into the center of coil 20 make direct contact with the coil bundle for it to absorb heat from the streams. The cooled liquids are then guided to the walls of shell 21 to sink downward and flow under the legs of firetube 22 for reheating and recycling.

In all the disclosures of FIGS. 2, 3, and 4 the inclination of the middle portions of the baffles is, in a general sense, inclined at an acute angle to the vertical. The specific geometry of the firetube and the positioning in the shell of the indirect heater require some variation in the specific cross sectional shape of the baffle above the firetube but in general each baffle is inclined to provide first a guiding surface which directs the rising medium (sinking medium in FIG. 4) to the side of the shell and second a guiding surface which directs the sinking medium (rising medium in FIG. 4) from the central portion of the tube bundle to below the firetube for heating. If the baffle, or baffles, are shaped to guide the directions of the heated rising and cooled sinking medium flows between the firetube and coil bundle the invention is presumatively embodied in the structure. As can be seen by the cross-sectional shape of the baffles in FIGS. 2, 3, and 4, the shape of the cross section may vary to accommodate the geometry of the firetube. But in general, the mid-section of the baffle in cross section is inclined from the vertical at an acute angle. This inclination is a common denominator to baffles embodying the invention.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

The invention, having been described, what is claimed is:

1. In an indirect heater comprising a horizontally extended shell within which a heat source is mounted to extend horizontally through a substantial length of the lower volume of the shell and a coil bundle is mounted to extend horizontally through a substantial length of the upper volume of the shell and the remainder of the shell volume being filled with liquid, wherein, the heat source is in the form of a return-bend firetube with both legs at substantially the same height above the bottom of the shell, and including, a baffle plate extended longitudinally and parallel closely above and substantially the length of each leg of the firetube with a substantial portion of its transverse dimensions inclined at an acute angle to the vertical with the plates diverging from each other, whereby those portions of the liquid body directly above each leg and on the underside of each baffle plate are heated by the legs and guided by the plates into rising streams flowed around the side of the coil bundle and then into direct contact with the coil bundle which cools them so that the portions sink in a stream which is directed down between the plates and then flows over the legs for reheating and recycling.

2. The heater of claim 1, wherein, the baffle plates are formed with a cross-section in the shape of an inclined S, the middle portion of the S being the substantial portion of the transverse dimension inclined at the acute angle to the vertical.

3. In an indirect heater comprising, a horizontally extended shell, a heat source in the form of a return-bend firetube mounted within the shell to extend horizontally through a substantial length of the lower volume of the shell, a coil bundle mounted within the shell to extend horizontally through a substantial length of the upper volume of the shell, liquid filling the remaining volume of the shell, a baffle plate extended longitudinally and parallel to and closely above and substantially the length of each leg of the firetube and having a substantial portion of its transverse dimensions inclined at an acute angle to the vertical with the plates converging toward each other to guide rising streams of heated liquid toward the center of the shell and upward into the center of the coil bundle, whereby the streams of liquid into the center of the coil bundle for direct contact with the coil bundle are cooled so that the streams thereafter sink and are directed toward the walls of the shell to flow under the firetube legs for reheating and recycling.

4. In an indirect heater comprising, a horizontally extended shell, a heat source in the form of a pair of return-bend firetubes mounted within the shell, the legs of each tube in a plane inclined at an acute angle to the vertical from the lower volume of the shell and with their lengths extended horizontally through a substantial length of the lower volume of the shell, a coil bundle mounted within the shell to extend horizontally through a substantial length of the upper volume of the shell, liquid filling the remaining volume of the shell, and a baffle plate extended parallel to and closely above and substantially the length of the legs of each return-bend firetube, forming a guide for rising streams of heated liquid toward the walls of the shell and upward into direct contact with the coil bundle which cools them so that the streams sink at the center of the shell to flow down between the plates and over the tubes for reheating and recycling.

* * * * *